US005836634A

United States Patent [19]

Finkelman

[11] Patent Number: 5,836,634

[45] Date of Patent: Nov. 17, 1998

[54] BAG HANGER UNIT

[76] Inventor: Jack Finkelman, 26-10 Union St. Apt 5B, Flushing, N.Y. 11354

[21] Appl. No.: 989,110

[22] Filed: Dec. 11, 1997

[51] Int. Cl.[6] ..... B65D 33/06

[52] U.S. Cl. ..... 294/159; 294/170

[58] Field of Search ..... 294/137, 158, 294/159, 162, 165, 166, 170, 87.1; 383/6, 13, 23; 16/114 R

[56] References Cited

U.S. PATENT DOCUMENTS

| | | | |
|---|---|---|---|
| D. 314,150 | 1/1991 | Precutti . | |
| 322,151 | 7/1885 | Beaumont | 294/170 |
| D. 336,732 | 6/1993 | Joyner . | |
| D. 340,863 | 11/1993 | Daigle . | |
| D. 361,264 | 8/1995 | West . | |
| D. 362,622 | 9/1995 | Van Davelaar . | |
| 763,104 | 6/1904 | Leuschner | 294/170 |
| 1,538,022 | 5/1925 | Brekke | 383/13 |
| 1,815,673 | 7/1931 | Kelley | 294/159 |
| 4,923,235 | 5/1990 | Stewart . | |
| 4,991,894 | 2/1991 | Rutens . | |
| 5,026,105 | 6/1991 | Feldman | 294/170 |
| 5,181,757 | 1/1993 | Montoya . | |
| 5,263,755 | 11/1993 | Thompson . | |
| 5,441,323 | 8/1995 | Goddard . | |
| 5,487,581 | 1/1996 | Carmo et al. . | |
| 5,509,708 | 4/1996 | Nathan . | |
| 5,516,155 | 5/1996 | Christensen . | |

FOREIGN PATENT DOCUMENTS

| | | | |
|---|---|---|---|
| 2541099 | 8/1984 | France | 294/170 |
| 394220 | 4/1924 | Germany | 294/170 |
| 2123280 | 2/1984 | United Kingdom | 294/162 |
| 2163344 | 2/1986 | United Kingdom | 294/87.2 |

*Primary Examiner*—Dean Kramer

*Attorney, Agent, or Firm*—Gottlieb, Rackman & Reisman, P.C.

[57] ABSTRACT

A hanger unit for carrying a plurality of plastic or other bags is provided. The hanger unit includes a handle and a plurality of bag carrying members cooperatively connected to and supported by the handle member. Each carrying member is defined by a clip element that is adapted for selectively engaging with the handle of a bag. The clip element includes a hook member on which the handle of the bag may be seated, and a leaf spring for selectively closing the hook member in order to capture the handle in the clip element.

6 Claims, 5 Drawing Sheets

BAG HANGER UNIT

BACKGROUND OF THE INVENTION

This invention relates to a bag hanger unit, and more particularly, to a hanger unit for carrying a plurality of plastic or other bags.

Plastic bags have gained enormous popularity by various retail establishments. Supermarkets and other businesses oftentimes only use plastic bags, or at least offer plastic bags as an alternative for carrying shopping items.

If a shopper has made several purchases from the supermarket, the shopper may find themselves to be in possession of several rather heavy plastic bags. These bags are often difficult to carry unless the store provides a wagon or some other carrying vehicle. If the shopper has to carry the number of bags by hand, they could easily be jarred loose, and the handles of bags may press too tightly around the shopper's fingers, possibly causing injury. Moreover, the sack portions of the bags tend to jar into each other, possibly causing damage to the contents of the bags.

Accordingly, it would be desirable to provide a hanger unit for carrying a plurality of plastic bags which overcomes the above disadvantages.

SUMMARY OF THE INVENTION

Generally speaking, in accordance with the invention, a hanger unit for carrying a plurality of plastic or other bags is provided. The hanger unit includes a handle and a plurality of bag carrying members cooperatively connected to and supported by the handle member. Each carrying member is defined by a clip element that is adapted for selectively engaging with the handle of a bag. The clip element includes a hook member on which the handle of the bag may be seated, and a leaf spring for selectively closing the hook member in order to capture the handle in the clip element.

Significantly, each of the clip elements is sufficiently spaced from one another in order for a plurality of bags to be carried thereby, without interfering with one another. In other words, the sacks of the plurality of bags would be suspended below the respective clip element. Even when the sack portions are substantially full, the bags will not press one against the other.

Preferably, each of the clip elements is disposed on the hanger unit at substantially the same height. As a result, a plurality of bags will be carried at a uniform height, preventing any propensity for the hanger unit to tip to one side or the other when being used.

The hanger unit is sized for being received in the trunk of a user's car, and is easily retrieved by grabbing the single bulbous shaped handle. Therefore, after purchasing items from a supermarket or grocery store, the purchaser can carry the plurality of bags by using the inventive hanger unit, and then place the entire unit with the carried bags into the trunk of his or her car for easy retrieval once arriving home. Because the unit includes clips for attachment to the bags, the bags will not roll all over the trunk, even during active driving conditions.

Accordingly, it is an object of the invention to provide an improved hanger unit for carrying one or more plastic or other carrying bags.

Still another object of the invention is to provide a bag hanger unit which includes members for engaging the handles of bags so the bags will not slip off when being carried.

A further object of the invention is to provide a bag hanger unit which carries the bags at a substantially uniform height.

Yet a further object of the invention is to provide a bag hanger unit which carries a plurality of bags sufficiently spaced from one another as to avoid damage to the contents of the bags.

Still other objects and advantages of the invention will in part be obvious and will in part be apparent from the following description.

The invention comprises the features of construction and arrangement of parts as depicted in the drawings, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE DRAWINGS

Figure 1:
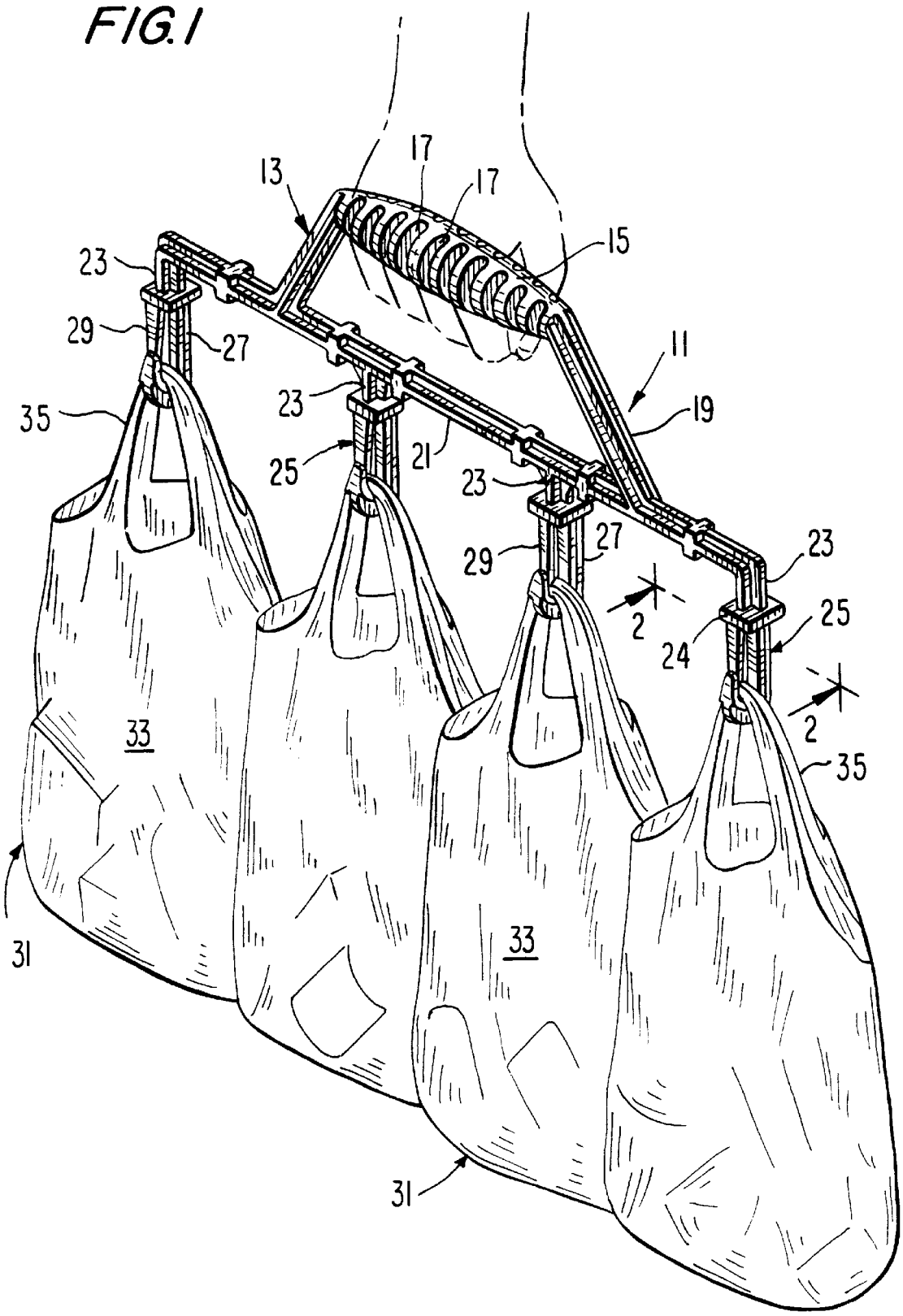
FIG. 1 is a perspective view of the preferred embodiment of the inventive bag hanger unit.

Referring to FIG. 1, the bag hanger unit of the invention, generally indicated at 11, is now described. Hanger unit 11 comprises a handle 13 coupled to a support bar 21 from which a plurality of clip elements 25 depend, in which clip elements 25 face a common forward direction for ease in attachment to the handles of bags, as shown. Handle 13 is defined by a hand grip 15 of a substantially cylindrical bulbous design and formed with a plurality of grooves 17 along the sides for reducing the weight of grip 15 and thereby facilitating gripping by the user thereof. Handle 13 further includes a pair of extending arms 19 for connecting grip 15 to support bar 21 as shown.

Support bar 21 has a length substantially greater than that of grip 15 and is formed with a plurality of struts 23 depending downwardly therefrom. Struts 23 each lead into a base element 24 from which clip elements 25 extend. Base elements 24 are provided in order to reinforce the strength of struts 23.

Figure 3:
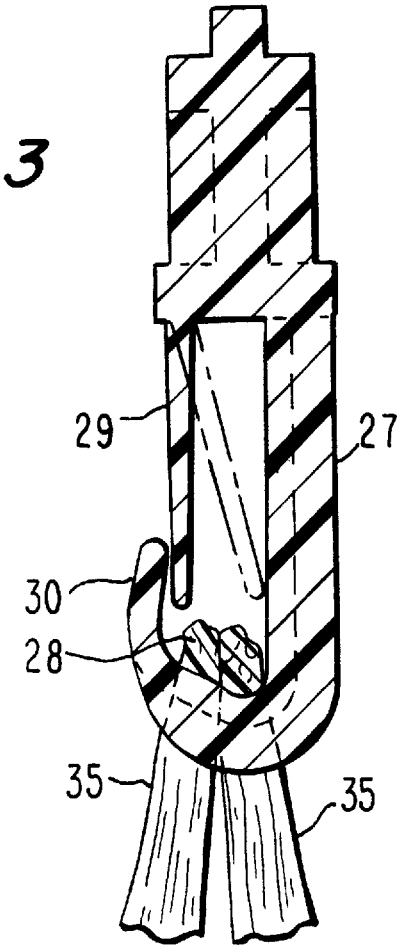
FIG. 3 is a cross-sectional view taken along line 3—3 of FIG. 2.
Figure 4:
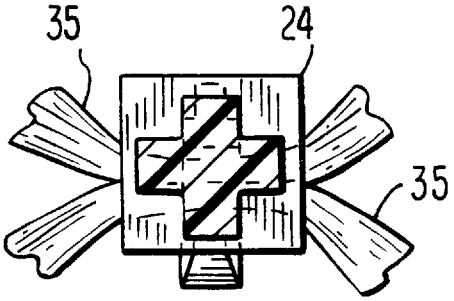
FIG. 4 is a cross-sectional view taken along line 4—4 of FIG. 2.

Each of clip elements 25 comprise a hook 27 and a leaf spring 29, both of which being integrally formed with base element 24 (see FIG. 3). Hook 27 forms a seat 28 on which one or more handles of a bag 31 may be supported. As shown in FIG. 1, each of bags 31 is defined by a sack portion 33 in which grocery or other items may be stored, and a pair of handles 35.

Figure 2:
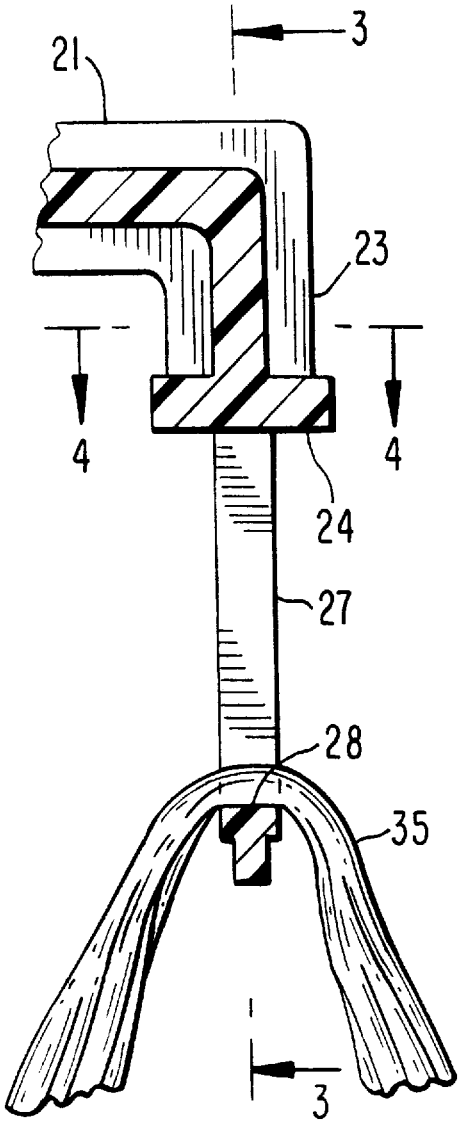
FIG. 2 is a cross-sectional view taken along line 2—2 of FIG. 1.

In use of hanger unit 11, a shopper typically buys several bags 31 of groceries. The bags, after purchase, are attached at handles 35 to clip elements 25, as best depicted in FIGS. 2 and 3. This is achieved by directing leaf spring 29 inwardly in order to create a space between end 30 of hook 27 and spring 29 through which handles 35 may be passed in order to seat handles 35 onto seat 28 of hook 27. Then, leaf spring 29 is released, thereby abutting against end 30 of hook 27 in order to capture handles 35 within clip element 25.

Figure 5:
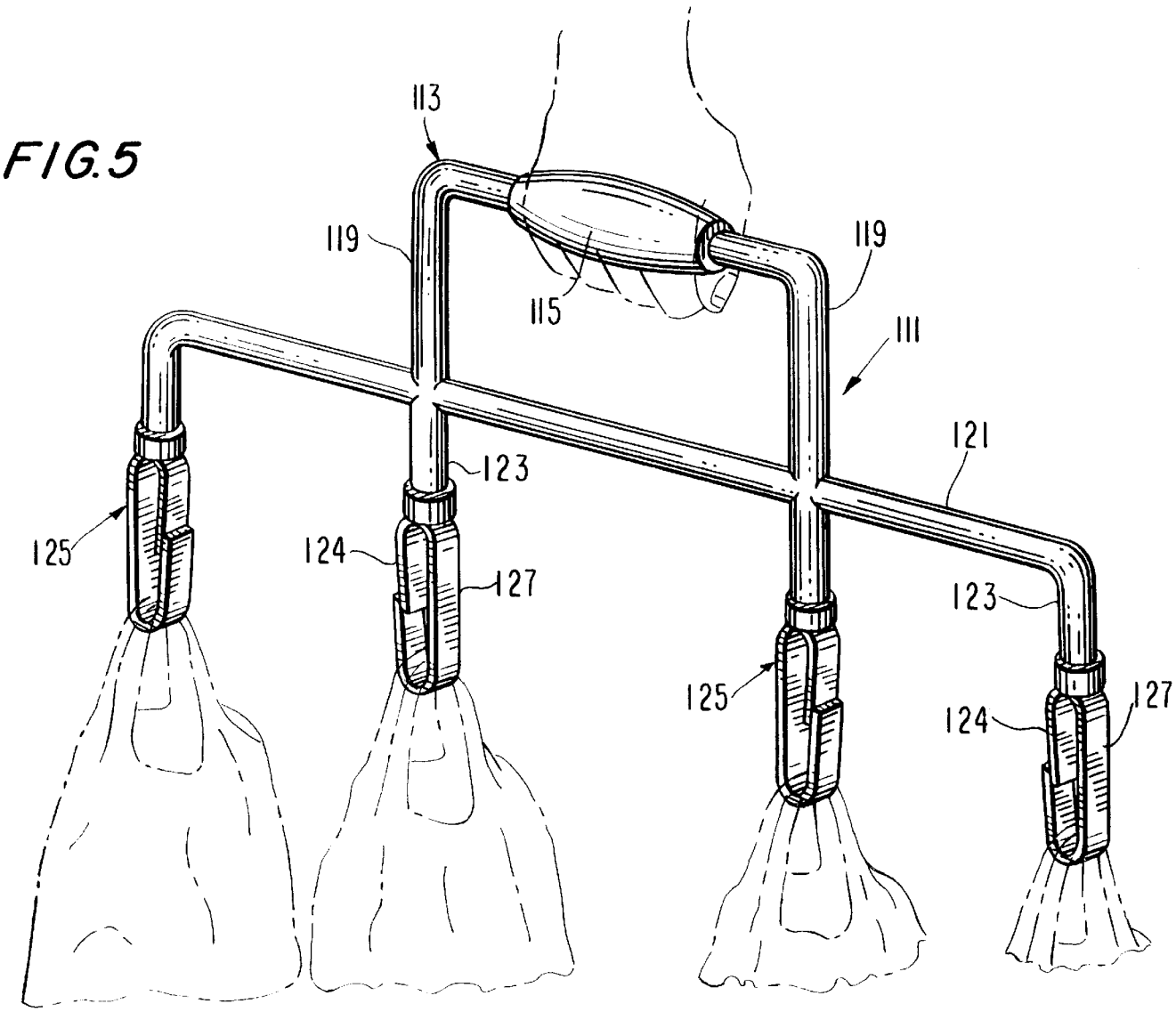
FIG. 5 is a perspective view of a second embodiment of the inventive bag hanger unit.

In the embodiment depicted in FIG. 5, a hanger unit 111 comprises a handle 113, a support bar 121 coupled to handle 113, and a plurality of clip elements depending from supporting bar 121. Handle 113 is defined by a bulbous shaped hand grip 115, the ends of which lead into a pair of arms 119 that are connected to support bar 121. Support bar 121 is formed with a plurality of depending struts 123 from which clip elements 125 are suspended. As before, each of clip elements 125 comprise a hook element 127 and a leaf spring 129, both of which are used in selectively capturing within clip element 125 the handles of a bag, as shown. In this particular embodiment, as shown in FIG. 5, adjacent clip elements are shown disposed in opposite directions. This feature will facilitate attaching the bag to the hanger unit as attachment can occur from opposite sides.

Figure 6:
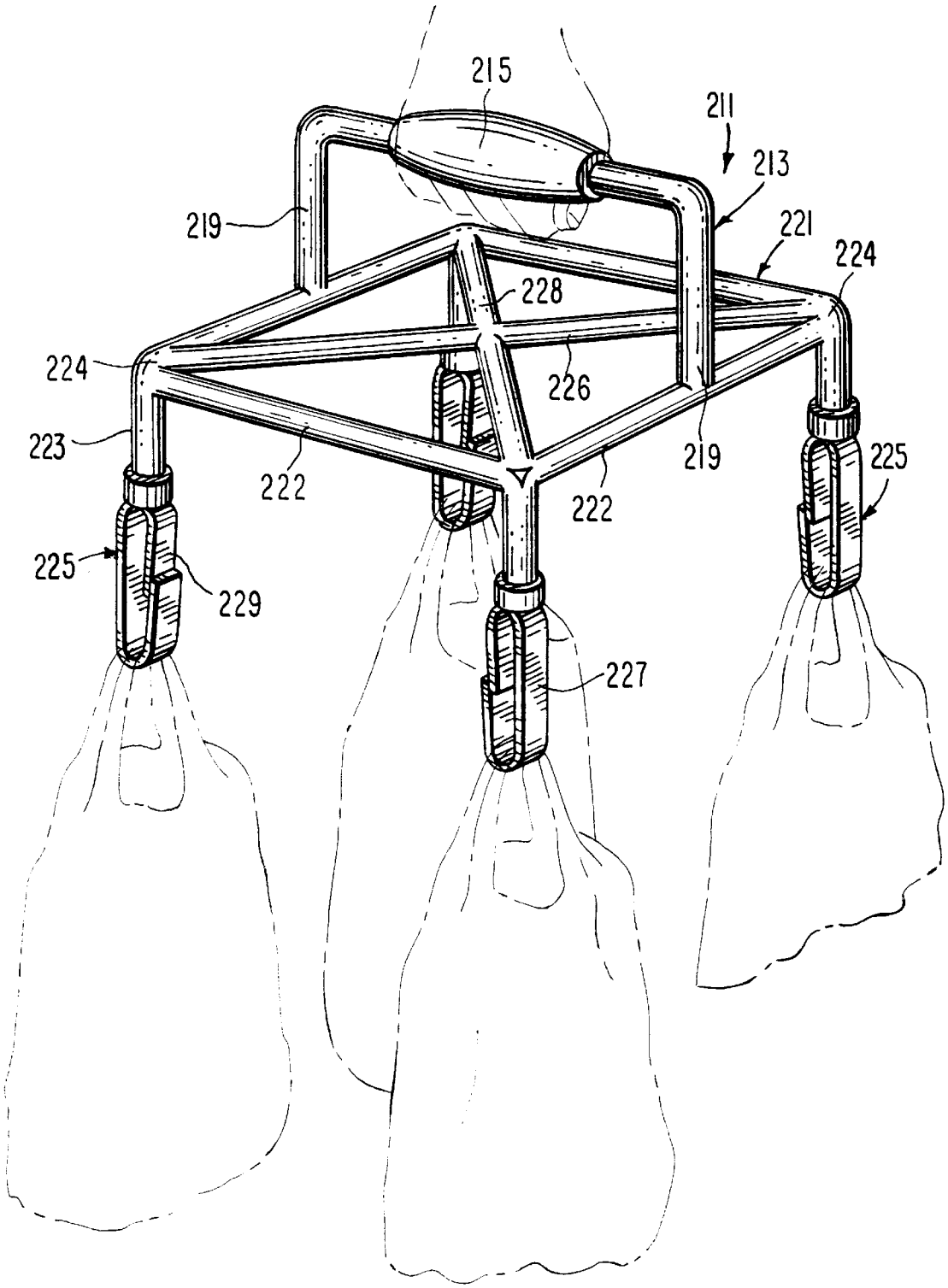
FIG. 6 is a perspective view of a third embodiment of the inventive bag hanger unit.

Turning now to FIG. 6, a third embodiment of the inventive hanger unit is described, and is generally indicated at 211. Hanger unit 211 comprises a handle 213, a support member 221 and a plurality of clip elements 225 depending from support member 221. Handle member 213 is similar in design to the handle of the embodiment depicted in FIG. 5, and consists of a bulbous shaped hand grip 215 from which a pair of arms 219 extend. Arms 219 are connected to support member 221 as shown. Member 221 has a substantially square configuration and comprises four sidebars 222 defining four corners 224 and a pair of crossbars 226 connected at either end to corners 224, as shown.

Unit 211 further includes a plurality of struts 223 depending from corners 224 of support member 221, and from which a plurality of clip elements 225 are carried. As before, clip elements 225 each comprise a hook 227 and a leaf spring 229 for selectively capturing the handles of a plurality of bags within clip elements 225.

Figure 7:
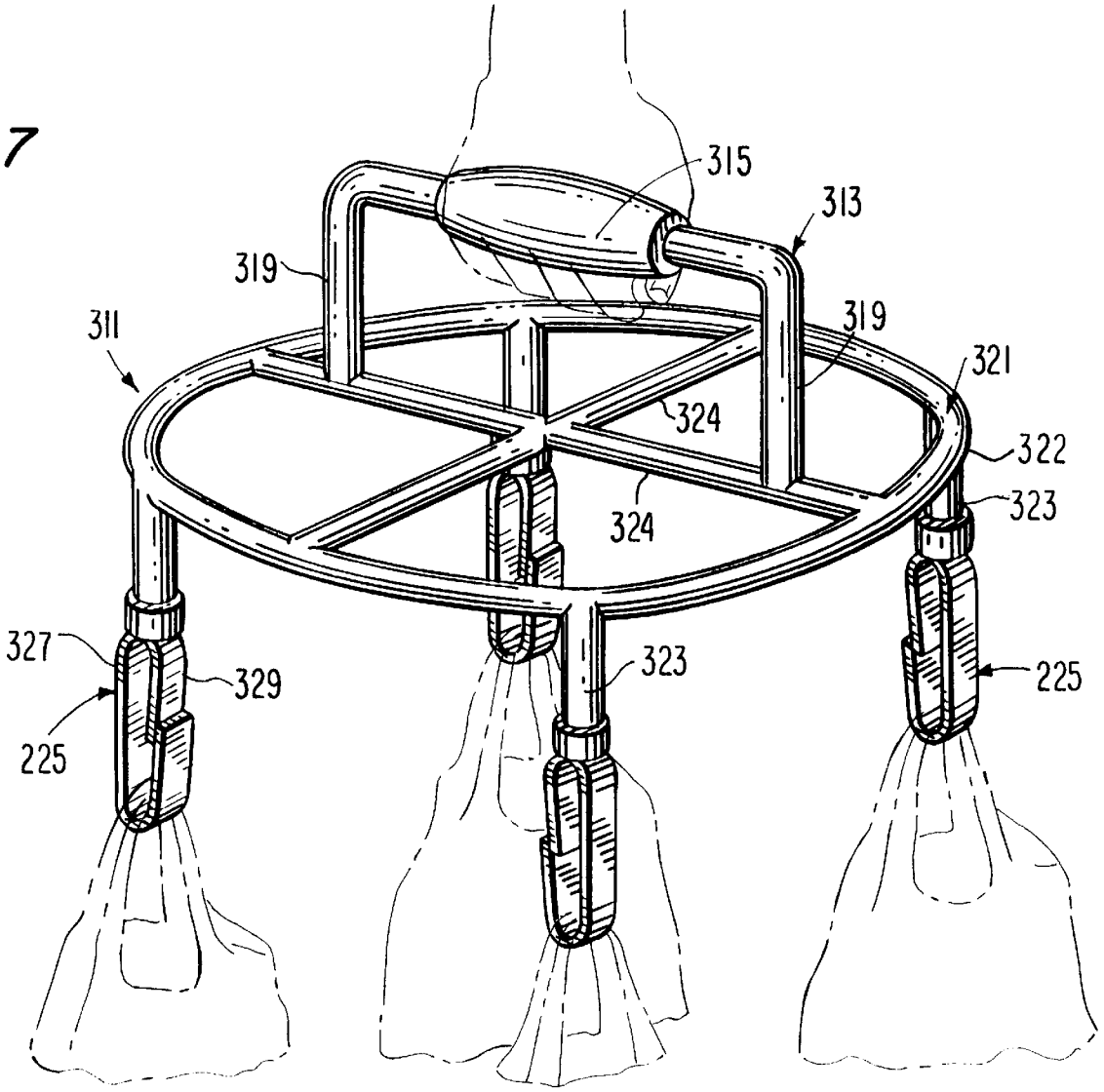
FIG. 7 is a perspective view of a fourth embodiment of the inventive bag hanger unit.

Referring now to FIG. 7, a fourth embodiment of the inventive hanger unit is generally indicated at 311. Hanger unit 311 comprises a handle 313, a support member generally indicated at 321, and a plurality of clip elements 325 depending from support member 321. As with the embodiments of FIGS. 5 and 6, handle member 313 includes a bulbous shaped handle grip 315 and a pair of arms 319. Support member 321 comprises a circular bar 322 and a pair of cross-figured bars 324 disposed within and fixed to bar 322. As can be appreciated, arms 319 of handle 315 are fixed to one of crossbars 324.

Still referring to FIG. 7, circular bars 322 each include a plurality of depending struts 323 from which clip elements 325 are supported. As before, each of clip elements 325 includes a hook 327 and a leaf spring 329 which are cooperatively used for capturing the handle of a bag, as previously described.

Significantly, in all embodiments, each of the plurality of clip elements are disposed at substantially the same height in the hanger unit. This will prevent any tipping or other imbalance when the unit is used to carry a plurality of bags.

In addition, as can be appreciated from all the embodiments, each of the clip elements is spaced one from the other at a sufficient distance so that one bag will not interfere with placement of another, even when the bags are filled with items.

It will thus be seen that the objects set forth above, among those made apparent from the preceding description, are efficiently attained, and since changes may be made without departing from the spirit and scope of the invention, it is understood that the above description is merely illustrative and does not otherwise limit the scope of the invention. The claims that follow define the inventive scope.

What is claimed is:

1. A hanger unit for carrying a plurality of bags, each having one extending handle, the hanger unit comprising:

an extending support bar with a first end and a second opposite end and having a plurality of rigid struts fixedly depending downwardly therefrom and spaced substantially equidistant one from the other with one of said struts depending substantially from said first end of said support bar, and a second of said struts depending substantially from said second end of said support bar;

a handle comprising a grip substantially centrally disposed above said support bar and under which at least some of said plurality of struts fixedly depend from said support bar, said grip having first and second ends from which first and second arms extend oppositely downward toward and are fixed to said support bar at locations therealong away from said support bar ends; and a plurality of self-closing clip elements corresponding in number to said plurality of struts, wherein each of said clip elements is connected to and non-movably hangs from its corresponding strut.

2. The hanger unit of claim 1, wherein said plurality of clip elements are comprised of four members.

3. The hanger unit of claim 1, wherein each of said clip elements is disposed at substantially the same lateral height with respect to said hanger unit.

4. The hanger unit of claim 1, wherein each of said clip elements is sufficiently spaced from one another to enable said plurality of bags to be carried by said hanger unit without any one bag interfering with another.

5. The hanger unit of claim 1, wherein said grip includes a plurality of grooves at least partially extending therealong.

6. The hanger unit of claim 1, wherein the clip elements face in a common direction.

* * * * *